US005195389A

United States Patent [19]

Isozumi

[11] Patent Number: 5,195,389

[45] Date of Patent: Mar. 23, 1993

[54] PLANETARY SPEED REDUCTION GEAR TYPE STARTER

[75] Inventor: Shuzou Isozumi, Hyogo, Japan

[73] Assignee: Mitsubishi Denki K.K., Tokyo, Japan

[21] Appl. No.: 770,010

[22] Filed: Oct. 2, 1991

[30] Foreign Application Priority Data

Oct. 9, 1990 [JP] Japan ..... 2-106404[U]

[51] Int. Cl.[5] ..... F02N 15/06

[52] U.S. Cl. ..... 74/7 E; 74/7 C; 310/83; 475/331

[58] Field of Search ..... 74/7 E, 7 C; 290/38 R, 290/38 C, DIG. 1; 310/83; 475/331

[56] References Cited

U.S. PATENT DOCUMENTS 4,587,861 5/1986 Morishita ..... 310/83 X
4,635,489 1/1987 Imamura et al. ..... 74/7 E
4,739,181 4/1988 Okamoto et al. ..... 74/7 R X

FOREIGN PATENT DOCUMENTS 58-63361 4/1983 Japan .

*Primary Examiner*—Allan D. Herrmann
*Attorney, Agent, or Firm*—Sughrue, Mion, Zinn, Macpeak & Seas

[57] ABSTRACT

A planetary speed reduction gear type starter comprising a planetary speed reduction gear unit and a DC motor is designed as follows: In the case where the motor is smaller in outside diameter than the planetary speed reduction gear unit, the inside diameter of the yoke is accordingly reduced; that is, the front end portion of the yoke is increased in inside diameter into a large diameter portion. The planetary speed reduction gear unit is fitted in the large diameter portion, with the front end of which a front bracket is engaged. Thus, only one kind of front bracket can be used for a plurality of planetary speed reduction gear type starters different in reduction gear ratio.

5 Claims, 2 Drawing Sheets

PLANETARY SPEED REDUCTION GEAR TYPE STARTER

BACKGROUND OF THE INVENTION

This invention relates to a planetary speed reduction gear type starter, in which an internal gear frame and a front bracket are mounted on a front end portion of a yoke for an electric motor, and more particularly to coupling means for the yoke and the front bracket.

FIG. 4 is a sectional view showing essential components of a conventional planetary speed reduction gear type starter disclosed in Japanese Utility Model Unexamined Publication No. Sho. 58-63361. In FIG. 4, a DC motor 1 comprises: a yoke 2 on which a field unit 3 including permanent magnets are mounted; a partition and bearing support 4 secured in the front end portion of the yoke 2; a rotary shaft 5 supported through a bearing 6 by the partition and bearing support 4; and an armature core 7 fixedly mounted on the rotary shaft 5, on which an armature winding assembly 8 is mounted.

Further in FIG. 4, a planetary speed reduction gear unit 10 is designed as follows: An internal gear frame 11 having an internal gear 11*a* is secured to the inner wall of the yoke 2. A plurality of planet gears are engaged with a sun gear 9 formed on the rotary shaft 5 and with the internal gear 11*a*. The planet gears revolves around the sun gear while rotating, so as to reduce the speed of rotation. The planet gears 12 are mounted through bearings 15 on support pins 14, which are fixedly embedded in a flange 13*a* formed at the rear end of an output shaft 13.

The output shaft 13 has a hole formed in its rear end portion. The output shaft 13 is supported by the rotary shaft 5 through a bearing 18 provided in the hole. A front cover 16 is provided to retain the internal gear frame 11. That is, the front cover 16 is secured to the front end face of the yoke 2 and abutted against the outer surface of the flange 13*a* of the output shaft 13, to prevent the movement of the internal gear frame 11 in the forward direction (to the left-handed side in FIG. 4). The yoke 2 is secured through the front cover 16 to a front bracket 17.

The output shaft 13 is coupled to an over-running clutch, which has a pinion at the front end in such a manner that it is engaged with the ring gear of the engine when the clutch is moved forwardly (not shown).

The conventional planetary speed reduction gear type starter thus constructed operates as follows: Upon energization of the armature winding assembly 8, the rotary shaft 5 is rotated with the aid of the armature. The speed of rotation of the rotary shaft 5 is reduced by the planetary speed reduction gear unit 10. The rotation thus speed-reduced is transmitted to the output shaft 13 to rotate the latter 13. As a result, the over-running clutch is rotated. The over-running clutch is moved forwardly by a shift lever (not shown) with the aid of an electromagnetic switch. Thus, the engine is started through the pinion.

In the above-described conventional planetary speed reduction gear type starter, the diameter of the planetary speed reduction gear unit 10 is determined from the inside diameter of the yoke 2, and the diameter of the motor 1 is inversely proportional to the reduction gear ratio which is determined from the number of teeth of the internal gear 11*a*. Therefore, in order to increase the reduction gear ratio, it is necessary to increase the size of the planetary speed reduction gear unit to an extent, and accordingly it is necessary to increase the diameter of the yoke 2. However, the increase in diameter of the yoke 2 impedes the miniaturization of the starter.

In order to eliminate the above-described difficulty, a technique of providing the reduction gear outside of the yoke has been proposed. However, the technique still suffers from the following disadvantages: The resultant starter is intricate in construction, and is increased in the number of manufacturing steps. Furthermore, in the case of manufacturing starters different in reduction gear ratio by the technique, it is necessary to form front brackets different in mounting means; that is, the number of kinds of front brackets is increased, thus hindering the standardization of the front bracket.

SUMMARY OF THE INVENTION

Accordingly, an object of this invention is to eliminate the above-described difficulties accompanying a conventional planetary speed reduction gear type starter. More specifically, an object of the invention is to provide a planetary speed reduction gear type starter in which, even if the planetary speed reduction gear unit is increased in size, only one and the same front bracket is used, so that the miniaturization of the motor is not restrained.

A planetary speed reduction gear type starter comprising a planetary speed reduction gear unit and a DC motor according to the invention is designed as follows: In the case where the motor is smaller in outside diameter than the planetary speed reduction gear unit, the inside diameter of the yoke is accordingly reduced; that is, the front end portion of the yoke is increased in inside diameter into a large diameter portion. The planetary speed reduction gear unit is fitted in the large diameter portion, with the front end of which a front bracket is engaged. Thus, only one kind of front bracket can be used for a plurality of planetary speed reduction gear type starters different in reduction gear ratio.

More specifically, the present invention provides a planetary speed reduction gear type starter in which a planetary speed reduction gear unit is coupled to a DC motor so that the rotation of the motor is transmitted to the output shaft of the starter through the planetary speed reduction gear unit, to rotate a pinion through an over-running clutch mounted on the output shaft which is provided on the front end portion of the clutch inner of the over-running clutch, comprising an improvement wherein: the yoke of the DC motor has a large diameter portion which is formed by increasing the inside diameter of the front end portion of the yoke; the planetary speed reduction gear unit has an internal gear frame which is fixedly fitted in the large diameter portion of the yoke; and a front bracket is engaged with the outer end of the large diameter portion of the yoke.

The present invention further provides a planetary speed reduction gear motor, comprising: a driving motor having a rotor; a planetary speed reduction gear unit including a sun gear formed on the rotary shaft, a plurality of planetary gears engaged with the sun gear and driven thereby, and a cylindrical frame having an internal gear formed on the inner cylindrical surface, the internal gear being engaged with the planetary gears; an output shaft formed with a flange for supporting the planet gears and driven by the revolution of the planet gears around the sun gear; a yoke including a small diameter portion for housing the driving motor and a large diameter portion having an inner diameter larger than that of the small diameter portion, for housing the planetary gear unit, the cylindrical frame being fixedly fitted on the inner cylindrical surface of the large diameter portion.

The planetary speed reduction gear motor according to the present invention may preferably comprises means for securely fixing the cylindrical frame to the inner cylindrical surface of the large diameter portion, including a step formed on the yoke between the small diameter portion and the large diameter portion, a bracket fixedly coupled to an open end of the large diameter portion, abutting the cylindrical frame, and a partition board provided between the step and the cylindrical frame for elastically depressing the cylindrical frame onto the bracket.

In the case where the reduction gear ratio is increased and accordingly the motor is decreased in outside diameter, the inside diameter of the yoke can be decreased. Therefore, only one kind of front bracket can be used which is formed in conformance to the inside diameter of the outer end of the large diameter portion.

BRIEF DESCRIPTION OF THE DRAWINGS

In the accompanying drawings.

In these figures, like parts are designated by like reference numerals or characters.

DETAILED DESCRIPTION OF THE PREFERRED EMBODIMENTS

Figure 1:
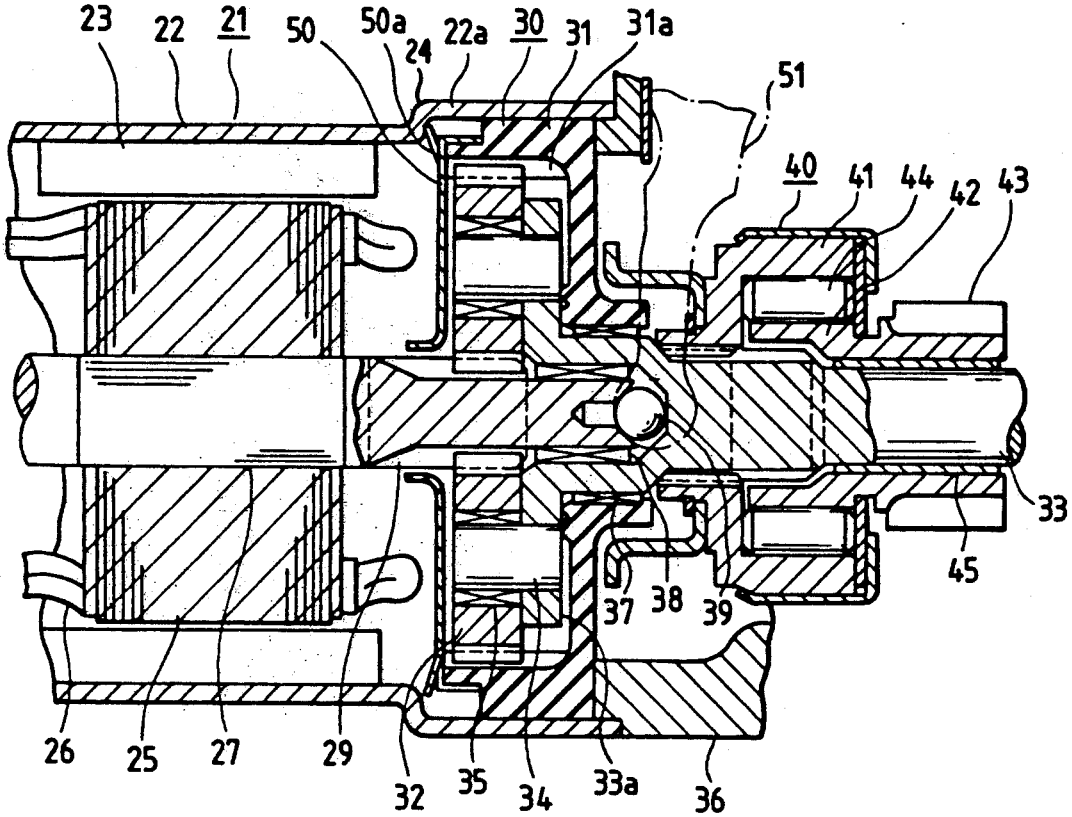
FIG. 1 is a sectional view showing essential parts of an example of a planetary speed reduction gear type starter which constitutes a first embodiment of this invention.

FIG. 1 is a sectional view showing an example of a planetary speed reduction gear type starter which constitutes a first embodiment of the invention.

In FIG. 1, a DC motor 21 is designed as follows: The front end portion of a yoke 22 is increased in inside diameter so as to form a large diameter portion 22*a*. A field unit 23 comprising a plurality of permanent magnets is mounted on the yoke 22. An armature core 25, on which an armature winding assembly 26 is mounted, is fixedly mounted on a rotary shaft 27. A small gear, namely, a sun gear 29 is formed on the front end portion of the rotary shaft 27.

Further in FIG. 1, a planetary speed reduction gear unit 30 is designed as follows: An internal gear frame 31 of synthetic resin, which has an internal gear 31*a*, is fixedly fitted in the large diameter portion 22*a* of the yoke 22. A plurality of planet gears 32, which revolve around the sun gear while rotating for reduction of the speed of rotation are engaged with the sun gear 29 and the internal gear 31*a*. The planet gears 32 are mounted through bearings 35 on support pins 34, which are fixedly embedded in a flange 33 formed at the end of an output shaft 33.

A front bracket 36 is engaged with the inner surface of the large diameter portion 22*a* of the yoke 22. The rear end portion of the output shaft 33 is supported through a bearing 37 by the internal gear frame 31, while the front end portion thereof is supported through a bearing (not shown) by the front bracket 36. The front end portion of the rotary shaft 27 is supported by the rear end portion of the output shaft 33; more specifically, it is supported through a bearing 38 and a steel ball 39 by a hole formed in the rear end portion of the output shaft 33.

An over-running clutch 40 is mounted on the output shaft 33. The over-running clutch 40 comprises: a clutch outer member 41 which is helical-spline-engaged with the output shaft 33; and a clutch inner member 42 which is supported through a bearing 45 on the output shaft 33. The front end portion of the clutch inner member 42 is formed into a pinion 43. The over-running clutch 40 further comprises a plurality of rollers 44 are interposed between the clutch outer member 41 and the clutch inner member 42.

A partition board 50 is provided between the motor 21 and the planetary speed reduction gear unit 30, in such a manner that it is coupled to the internal gear frame 31. The partition board 50 has a plurality of pawls 50*a*, which are elastically depressed against the step 24 of the large diameter portion 22*a* of the yoke 22 so as to prevent the rotation of the internal gear frame 31 with respect to the yoke 22.

Further in FIG. 1, a shift lever 51 is coupled to an electromagnetic switch (not shown). When the shift lever 51 is swung forwardly, the over-running clutch 40 is moved forwardly, so that the pinion 43 is engaged with the ring gear of the engine, to start the latter.

As was described above, the internal gear frame 31 is fixedly fitted in the large diameter portion 22*a* of the yoke 22, and the front bracket 36 is engaged with the large diameter portion 22*a*. Thus, the front bracket can be standardized. That is, the large diameter portion 22*a* of the yoke 22 is made large in inside diameter in advance, and the outside diameters of the internal gear frame 31 and the front bracket 36 are determined in compliance with the inside diameter of the large diameter portion 22*a*.

With the above-described embodiment, when it is required to provide a starter in which the reduction gear ratio of the planetary speed reduction gear unit 10 is larger, the inside diameter of the internal gear 31 can be increased to increase the number of teeth. When the reduction gear ratio is increased, then the motor is increased in speed, and it may be decreased in outside diameter. In this case, the other portion of the yoke 22 which accommodates the motor may be reduced in inside diameter.

Figure 2:
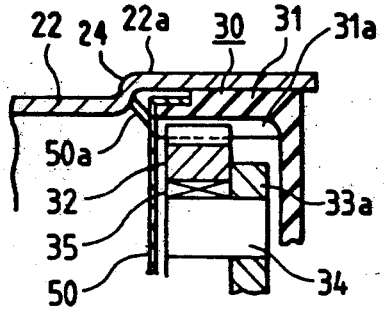
FIGS. 2 and 3 are sectional views showing other examples of the planetary speed reduction gear type start which constitute second and third embodiments of the invention, respectively, each showing the large diameter portion of a yoke and an internal gear frame therein.

FIG. 2 shows a part of another example of the planetary speed reduction gear type starter which constitutes a second embodiment of the invention. In the planetary speed reduction gear type starter, the internal gear 31*a* formed in the internal gear frame 31 is increased in the number of teeth; that is, the internal gear is increased in inside diameter.

Figure 3:
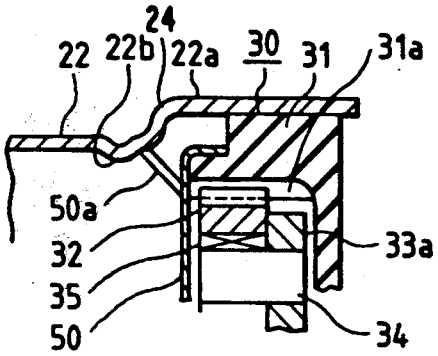
Figure 4:
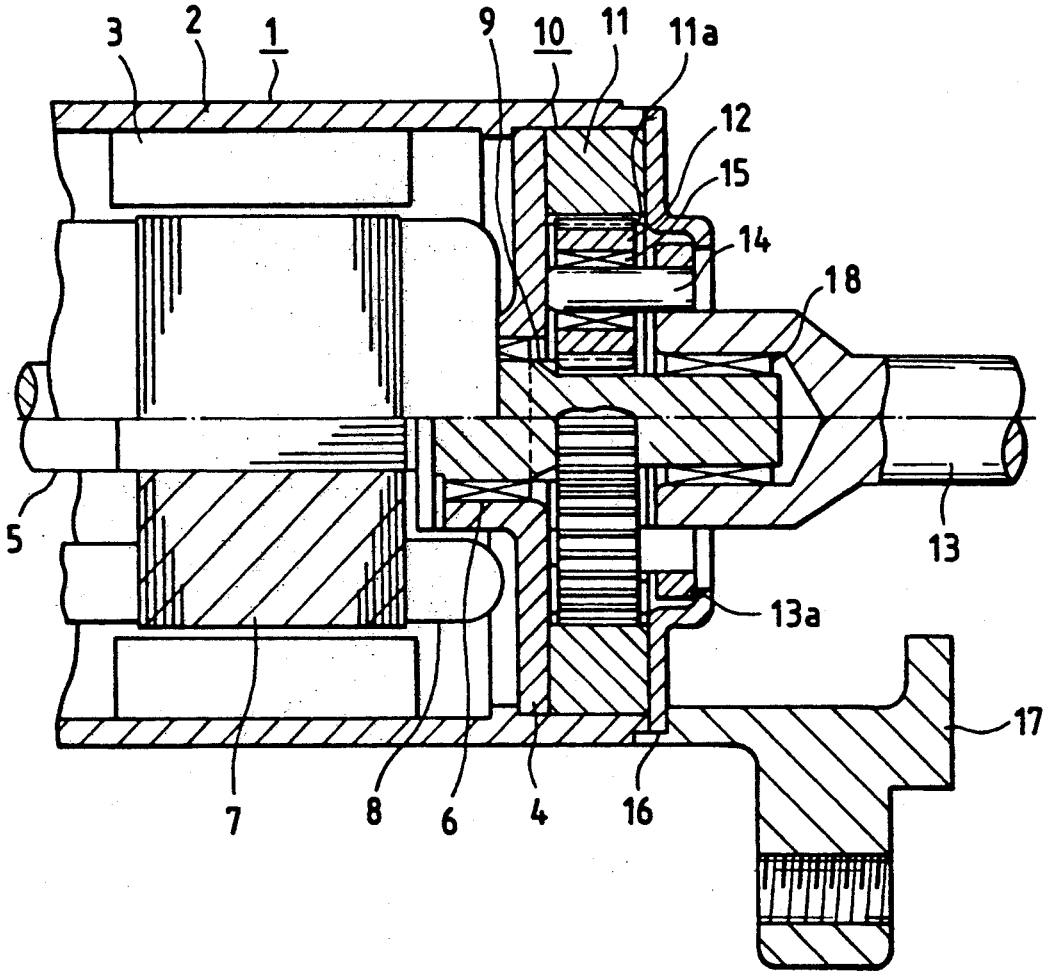
FIG. 4 PRIOR ART
FIG. 4 is a sectional view showing essential parts of a conventional planetary speed reduction gear type starter.

FIG. 3 shows a part of another example of the planetary speed reduction gear type starter which constitutes a third embodiment of the invention. In the planetary speed reduction gear type starter, the step 24 of the large diameter portion 22*a* of the yoke 22 has a protruded portion 22*b* which is protruded inwardly so that the pawls 50*a* of the partition board 50 are positively engaged with the step 24 of the large diameter portion 22*a* of the yoke 22.

The large diameter portion 22*a* of the yoke 22 is formed, for instance, on a press. In this case, it is preferable to increase the number of field poles, for instance, to six or eight, because the yoke may be small in thickness, and accordingly the pressing operation can be achieved with ease.

As was described above, in the planetary speed reduction gear type starter according to the invention, the front end portion of the yoke is made larger in inside diameter, thus providing the large diameter portion. The internal gear frame is fitted in the large diameter portion, with which the front bracket is engaged. Therefore, when it is required to provide a planetary speed reduction gear type starter larger in reduction gear ratio, the yoke can be formed in compliance with the reduction gear ratio. Therefore, only one kind of front bracket may be used for manufacture of planetary speed reduction gear type starters different in reduction gear ratio; that is, the front bracket is standardized as a component. And in the planetary speed reduction gear type starter of the invention, unlike the conventional planetary speed reduction gear type starter, can be miniaturized.

What is claimed is:

1. In a planetary speed reduction gear type starter in which a planetary speed reduction gear unit is coupled to a DC motor so that the rotation of said motor is transmitted to an output shaft of said starter through said planetary speed reduction gear unit, to rotate a pinion through an over-running clutch mounted on said output shaft which is provided on a front end portion of a clutch inner member of said over-running clutch, the improvement comprising:

a yoke including a small diameter portion for housing said motor and a large diameter portion having an inner diameter larger than an inner diameter of said small diameter portion;

a step formed on an outer surface of said yoke between said small diameter portion and said large diameter portion;

said planetary speed reduction gear unit including an internal gear fame which is fixedly fitted in said large diameter portion of said yoke;

a front bracket fixedly engaged with an outer end of said large diameter portion of said yoke; and means for biasing said internal gear frame against said front bracket, said biasing means being located in said large diameter portion between said step and said front bracket.

2. A planetary speed reduction gear motor, comprising:

a driving motor having a rotor;

a planetary speed reduction gear unit including, a sun gear formed on said rotary shaft, a plurality of planetary gears engaged with said sun gear and driven thereby, and a cylindrical frame having an internal gear formed on an inner cylindrical surface thereof, said internal gear being engaged with said planetary gears;

an output shaft formed with a flange for supporting said planetary gears and driven by the revolution of said planetary gears around said sun gear;

a yoke including a small diameter portion for housing said driving motor and a large diameter portion having an inner diameter larger than an inner diameter of said small diameter portion, for housing said planetary gear unit, said cylindrical frame being fixedly fitted on an inner cylindrical surface of said large diameter portion;

a front bracket fixedly coupled to an open end of said large diameter portion of said yoke;

a step formed on an outer surface of said yoke between said small diameter portion and said large diameter portion; and means for biasing said cylindrical frame against said front bracket, said biasing means being located in 3. The planetary speed reduction gear motor according to claim 2, further comprising:

an over-running clutch including, a clutch outer member mounted on said output shaft, a spline for engaging said clutch outer member with said output shaft and for allowing said clutch outer member to be moved along said output shaft, a clutch inner member mounted on said output shaft and movable with said clutch outer member, having a pinion, and a plurality of rollers interposed between said clutch outer member and said clutch inner member.

4. The planetary speed reduction gear motor according to claim 2, wherein said biasing means includes a partition board provided between said step and said cylindrical frame for elastically depressing said cylindrical frame onto said front bracket.

5. A planetary speed reduction gear motor, comprising:

a driving motor having a rotor;

a planetary speed reduction gear unit including, a sun gear formed on said rotary shaft, a plurality of planetary gears engaged with said sun gear and driven thereby, and a cylindrical frame having an internal gear formed on an inner cylindrical surface thereof, said internal gear being engaged with said planetary gears;

an output shaft formed with a flange for supporting said planetary gears and driven by the revolution of said planetary gears around said sun gear;

a yoke including a small diameter portion for housing said driving motor and a large diameter portion having an inner diameter larger than an inner diameter of said small diameter portion, for housing said planetary gear unit, said cylindrical frame being fixedly fitted on an inner cylindrical surface of said large diameter portion;

a step formed on said yoke between said small diameter portion and said large diameter portion; and means for securely fixing said cylindrical frame to the inner cylindrical surface of said large diameter portion;

wherein said means for securely fixing said cylindrical frame to the inner cylindrical surface of said large diameter portion includes a partition board provided between said step and said cylindrical frame for elastically depressing said cylindrical frame onto a bracket.

* * * * *